United States Patent [19]

Sendzimir

[11] Patent Number: 4,601,188

[45] Date of Patent: Jul. 22, 1986

[54] WORK ROLLS FOR A STRIP MILL HAVING ADJUSTABLE EDGE RELIEFS

[76] Inventor: Tadeusz Sendzimir, Weekeepeemee Rd., Woodbury, Conn. 06798

[21] Appl. No.: 747,660

[22] Filed: Jun. 21, 1985

[51] Int. Cl.[4] ..... B21B 27/02; B21B 31/18

[52] U.S. Cl. ..... 72/243; 29/113 AD; 29/125; 29/130; 72/35; 72/247

[58] Field of Search ..... 72/243, 247, 20, 21, 72/35; 29/113 AD, 113 R, 116 AD, 116 R, 117, 121.1, 121.5, 121.6, 122, 125, 130

[56] References Cited

U.S. PATENT DOCUMENTS 4,407,151 10/1983 Gronbech ..... 72/243 X

FOREIGN PATENT DOCUMENTS 0032508 2/1983 Japan ..... 72/247

*Primary Examiner*—Francis S. Husar
*Assistant Examiner*—Steve Katz
*Attorney, Agent, or Firm*—Frost & Jacobs

[57] ABSTRACT

A pair of work rolls is provided in a strip mill of the type having one or more back-up rolls for each work roll. Each work roll comprises a tubular body having an axial bore of uniform diameter throughout its length. The exterior surface of the tubular body has a cylindrical roll face of uniform diameter, terminating at its ends in neck portions of lesser diameter. The ends of the body are closed by removable fluid-tight plugs. A cylindrical mandrel of the same length as the roll face is mounted in the bore of each work roll and normally has an interference fit therein. The mandrels of the upper and lower work rolls are relieved at opposite ends. The remainder of the work roll bore at either end of the mandrel defines a pair of volumes in each work roll, filled with hydraulic fluid and individually controllable as to hydraulic pressure. When a strip is to be rolled, the mandrel of each roll is shifted to align its relief with one of the strip edges. In each work roll, the hydraulic pressure in that volume which must expand to shift the mandrel in the desired direction is increased until the interference fit of the mandrel becomes a sliding fit and the mandrel shifts as desired. In each work roll hydraulic fluid from the volume which must contract is allowed to escape, preventing pressure increase therein. Each work roll has an exterior indicator showing the position of the mandrel therein. Once positioned, the hydraulic pressure is relieved and the mandrel reassumes its interference fit.

8 Claims, 2 Drawing Figures

WORK ROLLS FOR A STRIP MILL HAVING ADJUSTABLE EDGE RELIEFS

TECHNICAL FIELD

The invention relates to a pair of upper and lower work rolls for a strip mill, and more particularly to such work rolls, each having adjustable edge relief.

BACKGROUND ART

In cold rolling metal strips under tension, especially when using small diameter work rolls, the edges of the strip have a tendency to become over-rolled, due to work roll deflection. When the strip edges are elongated to a greater extent than the strip center, the strip edges will tend to buckle.

The most usual prior art remedy for this problem has been to provide upper and lower backing rolls having tapered reliefs at opposite ends so as to accommodate both edges of the strip. Generally, means are also provided for shifting the backing rolls axially so as to position their reliefs appropriately with respect to the strip edges, depending upon the width of the strip being rolled.

The present invention is based upon the discovery that the upper and lower work rolls, themselves, can be provided with adjustable reliefs. The adjustable reliefs of the upper and lower work rolls being at opposite ends thereof to accommodate both edges of the strip being rolled. The reliefs are readily adjustable through the agency of hydraulic means, so that the same work rolls can accommodate strips of various widths.

The adjustable relief work rolls of the present invention have a number of advantages. First of all, no axial shifting of rolls is required. The invention can be applied to relatively large diameter work rolls, such as are used on four-high mills. The mill, itself, is simplified because the reliefs are provided within the work rolls, themselves, and no extra rolls are required. Finally, the invention can be applied to existing four-high and six-high strip mills, by leaving the backing rolls in tact and installing the work rolls of the present invention.

DISCLOSURE OF THE INVENTION

According to the invention there is provided a pair of upper and lower work rolls, having adjustable edge reliefs, for use in a strip mill of the type having one or more back-up rolls for each work roll.

Each of the upper and lower work rolls comprises a tubular body having a large axial bore of uniform diameter throughout its length. The exterior surface of the body comprises a cylindrical roll face of uniform diameter, terminating at its ends in neck portions of lesser diameter. The ends of the tubular body are closed by removable fluid-tight plugs.

A cylindrical mandrel is mounted in the bore of each work roll and normally has an interference fit therein. The cylindrical mandrel of each work roll has substantially the same length as that of the roll face. The mandrels of the upper and lower work rolls are relieved at opposite ends. The reliefs may take the form of tapered portions.

In each of the upper and lower work rolls, the remainder of the axial bore of the tubular body, at either end of the mandrel, defines a pair of volumes which are filled with hydraulic fluid. The pressure of the hydraulic fluid is individually controllable in each of the volumes of the work roll.

When a strip is to be rolled, the mandrels of each of the upper and lower work rolls are shifted to align their reliefs with the strip edges so as to gradually reduce the pressure exerted by the work roll at the strip edges. In each work roll, hydraulic fluid under pressure is introduced into that volume which must expand to shift the mandrel in the desired direction. The hydraulic pressure in that volume is raised so as to expand the tubular body of the roll and gradually change the interference fit between it and the mandrel to a sliding fit. As the pressure is increased, a point is reached where the partially relieved fit will yield to the hydraulic pressure, and the mandrel will slowly move under the influence of the hydraulic pressure. In the meantime, the hydraulic fluid in the other volume of the roll, which must contract, is allowed to escape to tank, thereby preventing a pressure increase in that volume.

As will be described hereinafter, indicia means may be provided for each roll to give a visual indication of the location of the mandrel therein.

DETAILED DESCRIPTION OF THE INVENTION

Figure 1:
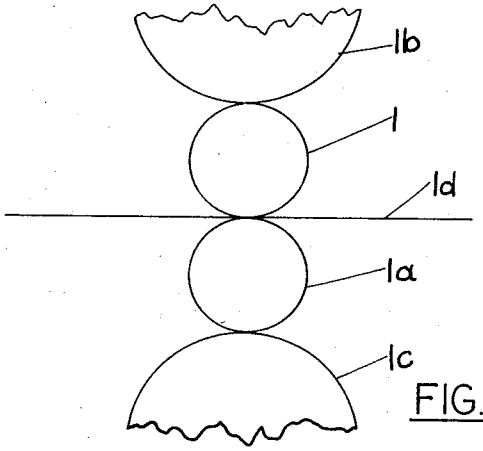
FIG. 1 is a diagrammatic representation of a four-high mill illustrating a metallic strip, a pair of work rolls and a pair of backup rolls.

As indicated above, the present invention is applicable to roll backed mills. FIG. 1 illustrates in a diagrammatic fashion an exemplary four-high mill provided with upper and lower work rolls 1 and 1*a* according to the present invention and a pair of upper and lower back up rolls 1*b* and 1*c*. FIG. 1 also illustrates a metallic strip 1*d* passing between work rolls 1 and 1*a*.

Figure 2:
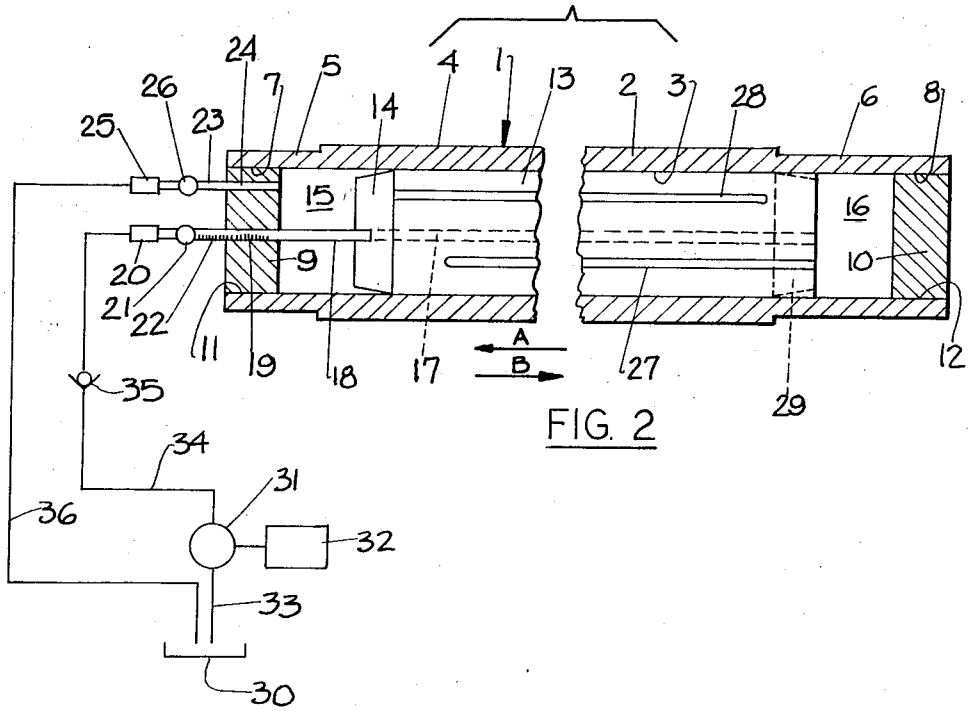
FIG. 2 is a fragmentary, longitudinal cross sectional view of a work roll of the present invention.

For purposes of description upper work roll 1 is illustrated in FIG. 2. The other or lower work roll 1*a* of the pair is substantially identical and differs in only one major respect, as will be set forth hereinafter.

The roll 1 comprises a tubular body 2 having an axial bore 3 of constant diameter. The bore 3 extends throughout the length of work roll 1. The exterior surface of tubular body 2 has a portion 4 of constant diameter which comprises the roll face of roll 1. The portion 4 terminates at each of its ends in portions 5 and 6, respectively. The portion 5 and 6 are of lesser exterior diameter and constitute the roll neck, by which the roll 1 is supported in the mill.

It will be noted that the axial bore 3, at the ends of necks 5 and 6, are internally threaded as at 7 and 8, respectively. A pair of disk-like metallic plugs 9 and 10, having peripheral threads 11 and 12, are threadedly engaged in the ends of the body 2 and form a fluid-tight seal therewith.

Mounted within tubular body 2 there is a cylindrical mandrel 13. Mandrel 13 has an exterior diameter such that it normally has an interference fit within axial bore 3 of tubular body 2. One end of mandrel 13 has a relieved portion 14. Preferably, the portion 14 is tapered as shown. It will be understood by one skilled in the art that the taper shown is exaggerated for purposes of description and clarity.

Mandrel 13 has a length equal to the length of the roll face 4. The remainder of bore 3 of tubular body 2 defines a pair of volumes 15 and 16. Volume 15 is defined by the left end of mandrel 13 (as viewed in the figure), the plug 9 and the bore 3. The volume 16 is defined by the right hand end of mandrel 13 (as viewed in the figure), the plug 10 and the bore 3. The volumes 15 and 16 are filled with hydraulic fluid.

It will be noted that mandrel 13 is, itself, is provided with an axial bore 17. The bore 17 extends completely through the mandrel 13. An elongated tube 18 is connected at one end in any appropriate fluid-tight manner to mandrel 13 such that it communicates with mandrel bore 17. The tube 18 passes through a bore 19 in plug 9. Conventional means (not shown) are provided enabling the tube 18 to be longitudinally slidable within plug bore 19, while at the same time being fluid-tight therein. At its free end, the tube 18 terminates in a coupling, diagrammatically shown at 20. Near the coupling, the tube has a valve 21.

It will be immediately apparent that tube 18 provides a direct means for introducing or removing hydraulic fluid into the volume 16. Since the tube is slidably mounted in the plug bore 19, it will shift axially with mandrel 13 (as will be described hereinafter). The exterior surface of tube 18 may be provided with appropriate indicia 22 indicating the position of mandrel 13 within the tubular body 2.

A second tube 23 extends through a bore 24 in plug 9. The tube 23 is fixedly mounted in bore 24, in fluid-tight fashion. Near its free end, the tube 23 terminates in a coupling, diagrammatically indicated at 25. Near the coupling 25, the tube 23 may be provided with a valve 26. It will be apparent that tube 23 constitutes a means by which hydraulic fluid may be introduced into or removed from volume 15.

To complete the roll 1, the mandrel 13 may be provided with a series of blind channels or flutes extending from its right-hand end (as viewed in the figure) to a point short of its left-hand end. One such flute is shown at 27. Similarly, the mandrel 13 may be provided with a series of blind channels or flutes extending from its left-hand end (as viewed in the figure) and terminating short of its right-hand end. One such flute is shown in the figure at 28. The number of blind flutes 27 does not constitute a limitation on the present invention. Preferably, they are three or more in number and evenly spaced about the periphery of mandrel 13. The same is true of flutes 28.

The figure has been arbitrarily designated as illustrating the upper work roll 1 of a pair. The lower work roll 1*a* can be identical to the upper work roll 1 in all respects. When the lower work roll 1*a* is identical to the upper work 1, the work rolls 1 and 1*a* must be oppositely oriented in the mill and the mandrels of the work rolls must be adjusted from opposite sides of the mill. For this reason, it is preferable that the lower work roll 1*a* be identical to the upper work roll 1 with the exception that the tapered or relieved end of its mandrel is opposite that of the mandrel of the upper work roll 1. This is indicated in the figure by broken lines at 29. When the upper and lower work rolls differ only in the locations of their relieved mandrel ends, the mandrels of both work rolls can be adjusted from the same side of the mill.

The work rolls having been described in detail, their operation may be set forth as follows. Each time the width of the strip to be rolled is altered, the mandrels must be shifted in the upper and lower work rolls so that the relieved ends of the mandrels are aligned with the edges of the strip. If, for example, the strip to be rolled is wider than that previously rolled, the mandrel 13 must be shifted in the direction of arrow A. This is accomplished by means of a source of hydraulic fluid under pressure. Such a source is illustrated diagrammatically in the figure and comprises a reservoir or tank of hydraulic fluid 30, a pump 31 and a pump motor 32. The pump 31 is connected to reservoir 30 by a line 33. The output of the pump is connected to a line 34 containing a check valve 35. A return line 36 to reservoir 30 is also provided.

To shift mandrel 13 in the direction of arrow A, the output line 34 of pump 31 is connected to coupling 20 of tube 18. The return line 36 is connected to the coupling 25 of tube 23. The pump 31 causes hydraulic fluid under pressure to be introduced into volume 16 by virtue of output line 34, tube 18 and mandrel bore 17. Fluid pressure is gradually increased in volume 16 resulting in expansion of tubular body 2 of roll 1. This gradually changes the interference fit between mandrel 13 and tubular body 2 to a sliding fit, aided by the presence of hydraulic fluid in blind channels 27 and 28. When the stage is reached where the fit between the mandrel 13 and the body 2 approaches a sliding fit, the mandrel 13 will move axially in the direction of arrow A and its position can be read from the indicia or graduations provided on tube 18 which shifts axially with mandrel 13. At the same time, hydraulic fluid from volume 15 escapes to tank or reservoir 30 by means of tube 24 and return line 36. This assures that the pressure does not build in volume 15. When the mandrel 13 reaches the desired position, the fluid pressure in volume 16 is dropped to atmospheric pressure and the interference fit between mandrel 13 and body 2 is re-established. As a consequence, the roll 1 can be used without danger of displacement of mandrel 13.

If the next strip to be rolled is narrower than the previous one, then mandrel 13 will have to be shifted in the direction of arrow B. Under these circumstances, the output line 34 of pump 31 is connected to the coupling 25 of tube 23, while the return line 36 is connected to the coupling 20 of tube 18. Pump 31 will cause the pressure in volume 15 to build until the interference fit between mandrel 13 and tubular body 2 is converted to a sliding fit and the mandrel 13 will shift in the direction of arrow B. In the meantime, the hydraulic fluid in volume 16 will pass through mandrel bore 17, tube 18 and return line 36 to reservoir, assuring that pressure does not build in volume 16. When the mandrel achieves its desired position, as shown by the indicia 22 on tube 18, the pressure in volume 15 will be reduced to atmospheric pressure, reinstating the interference fit between mandrel 13 and body 2. It will be understood that during adjustment of mandrel 13 within body 2, the tube valves 21 and 26 will be open. These valves will be closed whenever tubes 22 and 23 are disconnected from pump 31 and reservoir 30. It will also be understood that adjustment of the mandrel in the lower work roll 1*a* is accomplished in the same manner.

Since the provision of the relief 14 on mandrel 13 gradually reduces the pressure exerted by the work roll 1 upon the corresponding workpiece edge, the thickness of tubular body 2 at the roll face is critical and the calculations therefore must be confirmed by experiment on each new roll dimension. For the same reason, it is recommended that the amount of metal that may be ground off roll face 4 for maintenance be limited preferably to about 5% of its original thickness at roll face 4.

After that amount is removed, the roll should be re-surfaced by deposition of a hard metal by welding. There is a choice of suitable metals that are supplied in wire or powder form and mostly contained molybdenum or tungsten carbides. Such a renewed surface resists wear several times better than the hardened steel of the roll 1, itself, and thus the cost of producing metal strip in accordance with the present invention is quite economical.

For the initial assembly of a roll of the present invention, the tubular body 2 of the roll 1 is first thermally dilated, taking care not to exceed softening temperatures. The mandrel 13 is then pressed into tubular body 2 by hydraulic pressure, or the like. When a higher degree of interference fit is needed, the mandrel may be refrigerated prior to assembly.

The amount by which the mandrel 13 can shift in the body 2 is a matter of design choice. It depends, for example, on the range of widths of strip being rolled by the mill. A maximum shifting of mandrel 13 would be between a position wherein its relieved portion 14 is adjacent the corresponding edge of the roll face 4 and a position wherein the relieved portion 14 approaches the longitudinal center of the roll face 4. Under these circumstances, the neck portion 6 of the roll would have to be elongated so as to accommodate approximately ½ of the length of mandrel 13 which, it will be remembered, is of substantially the same length as the roll face 4.

Modifications may be made in the invention without departing from the spirit of it.

What is claimed is:

1. A work roll and a hydraulic system therefor for use in a roll backed cold strip mill said work roll having means within it for relief of the roll separating force at the strip edge, said work roll comprising a tubular body with a cylindrical roll face of uniform diameter terminating at its ends in neck portions of lesser diameter and having an axial bore of uniform diameter throughout, removable plugs mounted in and closing in fluid tight fashion the ends of said tubular body, a cylindrical mandrel having a length equal to the length of said roll face, said mandrel being located within said tubular body and normally having an interference fit therein, said mandrel having a relief formed at one end, the remainder of said bore at either end of said mandrel defining first and second volumes, said hydraulic system comprising a first tube passing through one of said plugs in fluid-tight fashion and communicating with the adjacent one of said first and second volumes for the introduction therein of hydraulic fluid under pressure and removal therefrom of hydraulic fluid, said mandrel having an axial passage therethrough, a second tube for said work roll being attached to said mandrel and connected to said axial passage therein in a fluid-tight manner, said second tube extending through said same plug with a sliding fluid-tight fit, said second tube communicating with the other of said first and second volumes via said mandrel passage for the introduction therein of hydraulic fluid under pressure and removal therefrom of hydraulic fluid, and a valve means connected to each of said first and second tubes to open and close said first and second tubes, said hydraulic system introducing hydraulic fluid under pressure into one of said first and second volumes to convert said interference fit between said tubular body and said mandrel to a sliding fit to axially shift said mandrel to a desired position in said tubular body while removing hydraulic fluid from the other of said first and second volumes to prevent pressure build up therein, and thereafter reducing said hydraulic pressure in said one of said first and second volumes to atmospheric reinstating said interference fit, said second tube being axially shiftable with said mandrel.

2. A pair of upper and lower work rolls and a hydraulic system therefor for use in a cold strip mill of the type having one or more back-up rolls for each work roll, each work roll comprising a tubular body having an axial bore of uniform diameter throughout, said tubular body having an exterior cylindrical roll face of uniform diameter terminating at its ends in neck portions of lesser diameter, plugs removably affixed in the ends of said tubular body in fluid tight fashion, a cylindrical mandrel of the same length as said roll face being mounted in said axial bore and normally having an interference fit therein, said mandrel having a relief at one end, the remainder of said bore at either end of said mandrel defining first and second volumes, said said hydraulic system comprising for each of said work rolls a first tube passing through one of said plugs in fluid-tight fashion and communicating with the adjacent one of said first and second volumes for the introduction therein of hydraulic fluid under pressure and removal therefrom of hydraulic fluid, said mandrel having an axial passage therethrough, a second tube for said work roll being attached to said mandrel and connected to said axial passage therein in a fluid-tight manner, said second tube extending through said same plug with a sliding fluid-tight fit, said second tube communicating with the other of said first and second volumes via said mandrel passage for the introduction therein of hydraulic fluid under pressure and removal therefrom of hydraulic fluid, and a valve means connected to each of said first and second tubes of each roll to open and close said first and second tubes, said hydraulic system introducing hydraulic fluid under pressure into one of said first and second volumes of each work roll to convert said interference fit between said tubular body and said mandrel of each work roll to a sliding fit to axially shift said mandrel of each work roll to a desired position therein while removing hydraulic fluid from the other of said first and second volumes of each work roll to prevent pressure build up therein, said thereafter reducing said hydraulic pressure in said one of said first and second volumes of each work roll to atmospheric reinstating said interference fit, said second tube of each work roll being axially shiftable with its respective mandrel.

3. The pair of upper and lower work rolls claimed in claim 2 wherein said work rolls are identical and oppositely oriented in said mill.

4. The pair of upper and lower work rolls claimed in claim 2 wherein said mandrels of said work rolls are relieved at opposite ends.

5. The pair of work rolls claimed in claim 2 wherein said mandrel relief comprises a tapered relief.

6. The pair of work rolls claimed in claim 2 including a plurality of blind fluid channels formed in the exterior surface of said mandrel of each roll, some of said channels extending longitudinally from said relieved end of said mandrel and terminating short of the non-relieved end thereof, some of said channels extending longitudinally from the non-relieved end of said mandrel and terminating short of said relieved end thereof, said channels being evenly spaced about the periphery of said mandrel.

7. The pair of work rolls claimed in claim 2 wherein said second tube of each roll has indicia thereon to indicate the position of its respective mandrel within its respective tubular body.

8. A method of cold rolling a metallic strip without over-rolling the strip edges comprising the steps of providing a pair of work rolls each comprising a tubular body having a substantially cylindrical roll face and a mandrel located within said tubular body and having an interference fit therein, said mandrel having a length substantially equal to the length of said roll face, providing said mandrels of said work rolls with reliefs formed at opposite ends thereof, sealing the ends of the tubular body of each of said rolls to form first and second volumes to either end of said mandrel therein, maintaining hydraulic fluid in said first and second volumes, introducing hydraulic fluid under pressure into one of said first and second volumes to elastically expand said tubular body and shift said mandrel therein and removing hydraulic fluid from the other of said first and second volumes to prevent pressure build-up therein, and returning said one of said first and second volumes to atmospheric pressure to reinstate said interference fit between said tubular body and said mandrel, suitably backing said work rolls and passing said strip under tension through the bite of said work rolls.

* * * * *